United States Patent [19]

Locke et al.

[11] Patent Number: 4,917,678

[45] Date of Patent: Apr. 17, 1990

[54] DEPILATORY DEVICE

[75] Inventors: David R. Locke, Bridgeport, Conn.; Pieter L. Lochner, Surrey, England

[73] Assignee: Remington Products, Inc., Bridgeport, Conn.

[21] Appl. No.: 239,456

[22] Filed: Sep. 1, 1988

[51] Int. Cl.[4] ..... A61B 17/50

[52] U.S. Cl. ..... 606/133

[58] Field of Search ..... 128/355; 17/11.1 R; 132/73, 73.6; 606/131, 133; 30/34.2, 43.6

[56] References Cited

U.S. PATENT DOCUMENTS 2,004,581 6/1935 Meyer ..... 128/355

FOREIGN PATENT DOCUMENTS 2307491 12/1976 France ..... 128/355

*Primary Examiner*—Michael H. Thaler
*Assistant Examiner*—William Lewis

[57] ABSTRACT

An improved depilatory device is disclosed which includes a plurality of rotating, generally cylindrically shaped, hair removal members having axes which are orientated substantially perpendicular to a subject's skin surface at a body site from which hair is to be removed. The subject's hair is engaged between juxtaposed surfaces of the members and is uprooted.

25 Claims, 3 Drawing Sheets

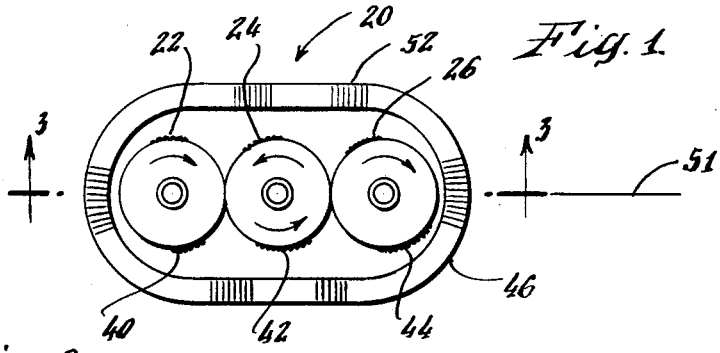
Fig. 1.
Fig. 2.
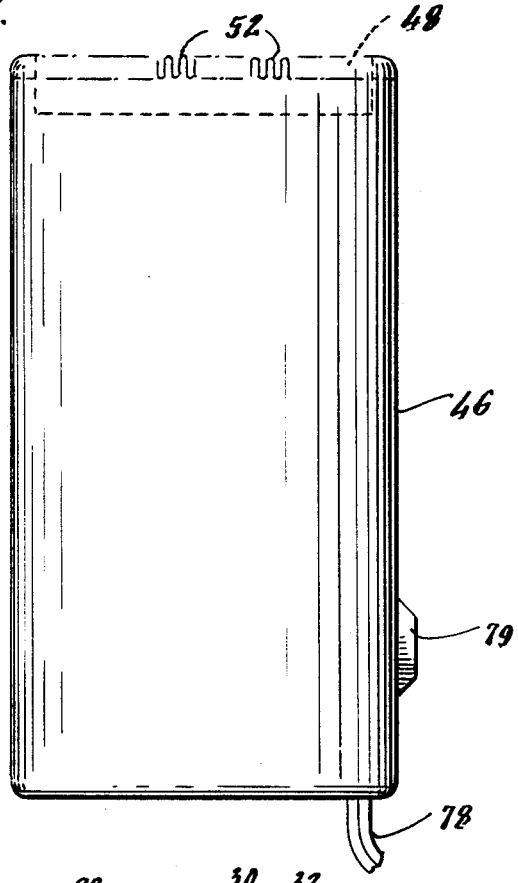
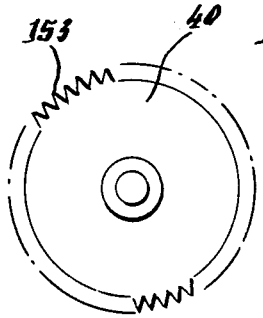
Fig. 4.
Fig. 15.
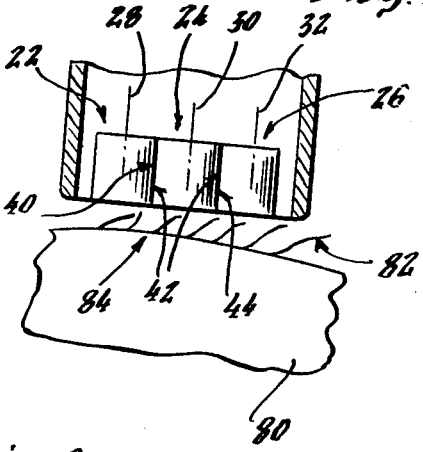
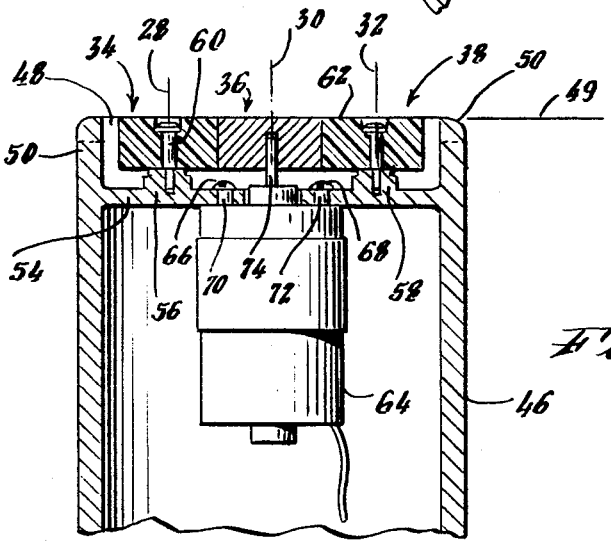
Fig. 3.

DEPILATORY DEVICE

FIELD OF THE INVENTION

This invention relates to depilatory devices. The invention relates more particularly to an improved form of hand held, electrically energized depilatory device for removing body hair.

BACKGROUND OF THE INVENTION

Hand held, electrically operated depilatory devices are known in the art and are utilized for removing human body hairs for cosmetic and other purposes. In general, such devices operate by engaging the subject's body hair with a moving member which member applies a removal force to the hair to uproot it. One such device is intended to engage and grip the subject's body hair with a rotating helix shaped spring. A device of this type is described, for example, in U.S. Pat. No. 4,524,772. Another such device is intended to engage the subject's body hair between a moving and a stationery member. A device of this type is described in U.S. Pat. No. 4,279,253.

The techniques described in these patents and other prior art depilatory devices for removing human body hair have shortcomings, one of which is the failure to adequately remove relatively short body hairs. Engagement of body hair by the prior art moving members sufficient to assure an uprooting grip on hairs generally requires that the hair being removed be relatively long. However, when the body hair to be removed is less than about 3 mm in length, the prior art devices are generally inadequate to establish sufficient engagement with these shorter hairs in order to exert a removal force on the hair.

SUMMARY OF THE INVENTION

Accordingly, it is an object of this invention to provide an improved depilatory device for the removal of body hairs.

Another object of the invention is to provide a depilatory device for removing relatively short body hairs.

A further object of the invention is to provide an improved depilatory device for removing both relatively short and relatively longer body hairs.

A depilatory device in accordance with the general features of the invention comprises a plurality of hair removal members each comprising a generally cylindrically-shaped body having a peripheral surface, a longitudinal axis and an end surface thereof. The peripheral surfaces are positioned in engagement. An electrically energized motor means is provided for imparting rotary motion to the members. By juxtapositioning the end surfaces with a body site from which hair is to be removed and by manually orientating the members axes substantially perpendicular to a subject's skin at the body site, body hair will be gripped between the engaged peripheral surfaces of rotating hair removal members and is uprooted. Advancing movement of the device so orientated along the body site will crop both relatively short and relatively longer body hairs.

In accordance with more particular features of the invention, a depilatory device includes a hand held housing which can be readily advanced along a subject's skin at a body site for removal of body hair. The housing includes an aperture at which a plurality of rotating hair removal members are located. These members comprise generally cylindrically-shaped bodies.

An electrically energized motor means is positioned in the housing and imparts rotating motion to the members. Peripherial surfaces of the members are located in juxtaposed engagement and end surfaces of the members are positioned adjacent the housing aperture. The end surfaces of the hair removal members are preferably positioned relatively flush with the housing aperture, and, alternatively extend slightly beyond the housing surface forming the aperture. Positioning the housing aperture in juxtaposed relationship with respect to the subject's skin at a body site at which hair is to be removed and orientating the housing so that longitudinal axes of the rotating members are substantially perpendicular to the subject's skin enables the subject's body hair to become engaged and gripped between the peripherial surfaces of the rotating members and to be uprooted.

In accordance with other features of the invention, a relatively large, generally cylindrically-shaped member of diameter D is provided and a plurality of members of relatively smaller diameter are arrayed about the larger member with the peripherial surfaces of each of the relatively smaller members positioned in juxtaposed engagement with the peripherial surface of the larger member. In an alternative embodiment of this arrangement, the array of relatively smaller diameter members are mounted on a rotatable support for providing that the array itself rotates about the rotating larger member.

In a preferred embodiment, a first of the hair removal members is coupled to the motor means for causing rotation thereof. The first member, by virtue of its peripherial surface engagement with a second member imparts rotary motion to the second member. The peripheral surfaces of the first or second member or both are preferably recessed to both enhance the gripping engagement of hairs between the surfaces and the driving engagement between these surfaces. Such recessing comprises scoring or knurling of the surfaces or forming tooth shaped segments therein.

BRIEF DESCRIPTION OF THE DRAWINGS

These and other objects and features of the invention will become apparent with reference to the following specification and to the drawings wherein:

FIG. 1 is a top plan view of one embodiment of a depilatory device constructed in accordance with features of this invention;

FIG. 2 is a side elevation view of the device of FIG. 1;

FIG. 3 is a fragmentary side elevation view, partly broken away and partly in section of the depilatory device of FIG. 1;

FIG. 4 is an enlarged top plan view of a rotary body used with the device of FIG. 1;

DETAILED DESCRIPTION

Figure 5:
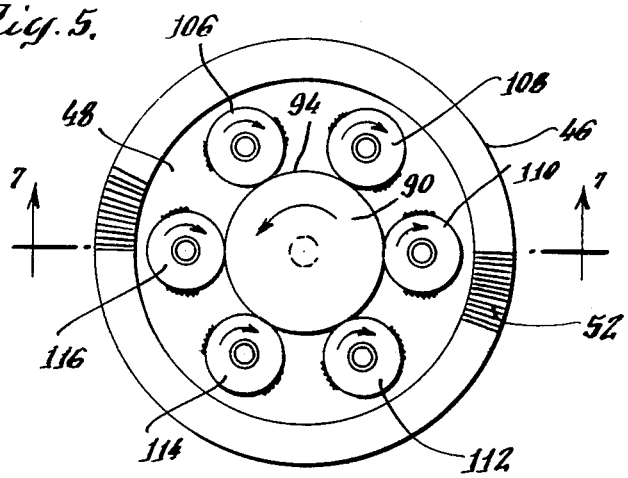
FIG. 5 is a top plan view of an alternative embodiment of the invention.

Referring now to the drawings and particularly to FIGS. 1–4, a depilatory device indicated generally by reference numeral 20 is shown to include a plurality of hair removing members 22, 24 and 26. Each of these members comprises a generally cylindrically shaped body having a longitudinal axis 28, 30 and 32 respectively (FIG. 3), an end surface 34, 36 and 38 respectively and a peripheral surface 40, 42 and 44 respectively. The members 22, 24 and 26 are positioned adjacent an aperture 48 formed at one end of a hand-held housing 46. The housing 46 is formed, for example, of a relatively light weight rigid polymer plastic such as CYCOLAC. Surfaces 34, 36 and 38 extend in a same plane represented, as illustrated in FIG. 3, by the line 49 and are preferably flush with a distal end segment 50 of the housing which defines the aperture 48. This distal end segment 50 includes a plurality of comb teeth 52 integrally formed therein and extending about the periphery of the aperture 48. The axes 28, 30 and 32 are also shown aligned in a same rectilinear plane represented in FIG. 1 by the line 51.

A means for rotatably mounting the hair removal members 22 and 26 comprises a shelf 54 which is integrally formed within the housing 46 and which includes hub segments 56 and 58. A support shaft 60 is provided and is mounted, by press fitting for example, in the hub 56. The shaft 60 provides a bearing about which the member 22 rotates. Similarly, a shaft 62 is also provided and is press fitted to the hub 58. The shaft 62 also provides a bearing about which the hair removal member 26 rotates.

An electrically energized means is provided for imparting rotary motion to the hair removal members 22, 24 and 26. The electrically energized means comprises an electric motor 64 which is mounted to the shelf 54 by screws 66 and 68 extending through apertures 70 and 72 respectively which are formed in the shelf. A rotary drive shaft 74 of the motor 64 extends through a centrally located aperture 76 and is coupled to the hair removal member 24, for example by press fitting. Electrical energy is applied to the motor from a line source through a line cord 78. The voltage applied to the motor 64 is at line potential or alternatively it can be stepped down and rectified by means well known to provide energy for a relatively low voltage DC motor. Alternatively, the motor 64 may be energized by a battery means comprising dry cells or by rechargeable batteries. A slide switch 79 is provided and is manually actuated by the user to energize the motor which thereby imparts rotary motion to the hair removing member 24.

The axes 28, 30 and 32 of hair removal members are spaced apart a distance for providing that the peripheral surfaces 40 and 44 of the hair removal members 22 and 26 are positioned in juxtaposed engagement with the peripheral surface 42 of the hair removal member 24. Upon rotary motion of the member 24, the engagement between the peripheral surfaces imparts rotary motion to the rotably mounted members 22 and 26. As illustrated in FIG. 1, a counterclockwise rotation of the member 24 will, by virtue of the engagement between the peripheral surfaces, impart rotary motion to the rotably mounted members 22 and 26 in an opposite clockwise direction.

As illustrated in FIG. 15, the plurality of members 22, 24 and 26 of the device of FIG. 1 are positioned at a body site 80 from which hairs 82 are to be removed, and, in juxtaposed relation with respect to the surface 84 of a subject's skin. Orientating the members 22, 24 and 26 with their axes 28, 30 and 32 in a substantially perpendicular attitude relative to the surface 84 enables body hairs 82 to be gripped at and between the peripheral surfaces of the rotating members and to be uprooted.

Figure 6:
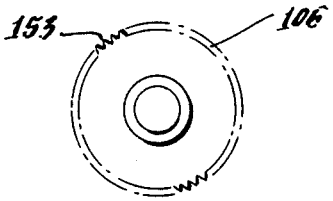
FIG. 6 is an enlarged top plan view of a rotary body used with the device of FIG. 5.
Figure 7:
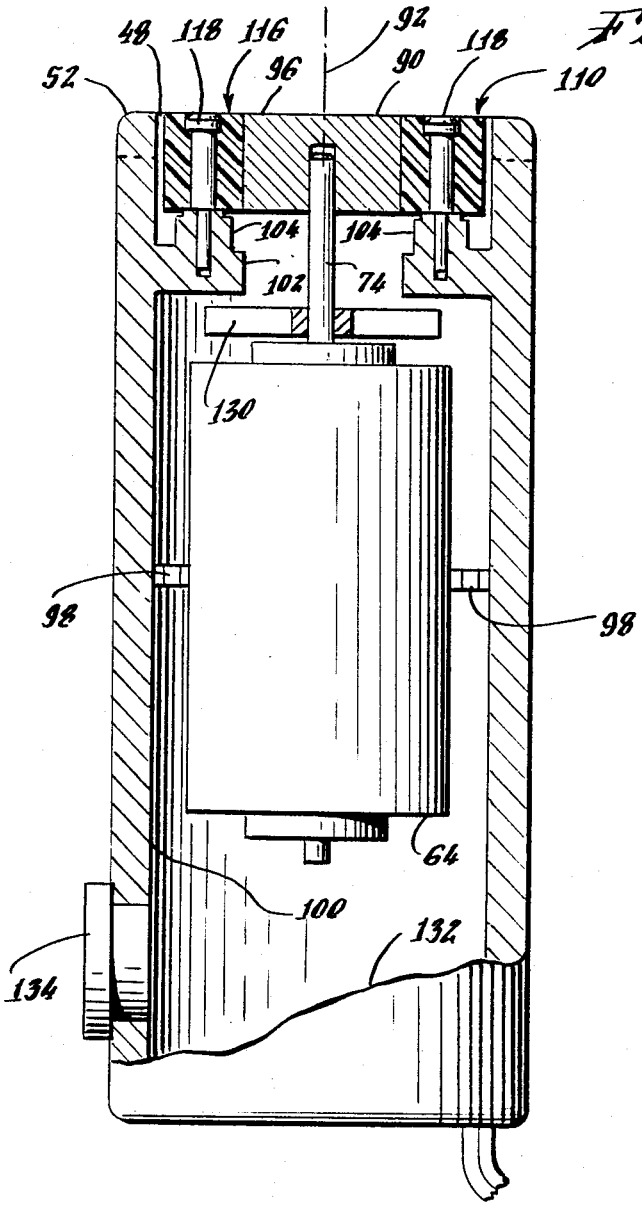
FIG. 7 is a side elevation view, partly broken away and partly in section of the device of FIG. 5.

An alternative embodiment of the device is illustrated in FIGS. 5, 6 and 7. Reference numerals referring to similar elements as were described with respect to FIGS. 1–4 are used in FIGS. 5 through 7. In the arrangement of FIGS. 5–7, a hair removal member 90 comprises a generally cylindrically shaped body having a longitudinal axis 92, a peripheral surface 94 and an end surface 96. The member 94, which has a diameter (D), is driven by an electrically energizing means comprising the motor 64 having a drive shaft 74 which is mounted, by press fitting, for example, to the member 90. Electrical energization of the motor 64 imparts rotary motion to the centrally located hair removal member 90. The motor 64 is mounted within the housing 46 at a central location by a perforated spider 98 which engages the motor and an inner wall 100 of the housing 46 but allows passage of hair particles therethrough, as described below.

A collar 102 is integrally formed in the housing 46 and includes an array of a plurality of hubs 104 for rotably supporting a plurality of hair removal members 106–116. Each of the hair removal members 106–116 is rotably mounted to a hub segment 104 formed in the collar by a bearing shaft 118 about which the member rotates. The members 106–116 are positioned in a circular array about the member 90 with the peripheral surfaces of these members positioned in juxtaposed engagement with the peripheral surface 94 of the centrally located hair removal member 90. The diameter of the hair removal members 106–116 is less than the diameter (D) of the centrally locating member 90. Upon energization of the motor 64 by line voltage or by battery means, as referred to hereinbefore, rotary motion is imparted to the centrally positioned hair removal member 90. Engagement between the peripheral surface 94 of this member and the peripheral surfaces of the members 106–116 causes rotation of each of these members as indicated in FIG. 5. As described with respect to FIG. 15, when the axes of the plurality of members of this embodiment are orientated with respect to the surface 84 of skin at a body site 80 in a substantially perpendicular direction, the hairs 82 will be engaged between the peripheral surfaces of the member 90 and the members 106–116 and will be uprooted.

FIG. 7 illustrates a fan 130 mounted to the motor drive shaft 74 for rotation therewith. An air stream is created by the fan in the housing and exits through a filter, not shown, in the lower housing. This air stream aids the comb in causing hairs which are to be uprooted to extend toward the hair removal members. Hairs which become entrapped and uprooted and which are free to enter the housing interior will be drawn into and collect in a bottom sector 132 of the housing 46. A removable plug 134 is provided for discarding the hairs so collected.

Figure 8:
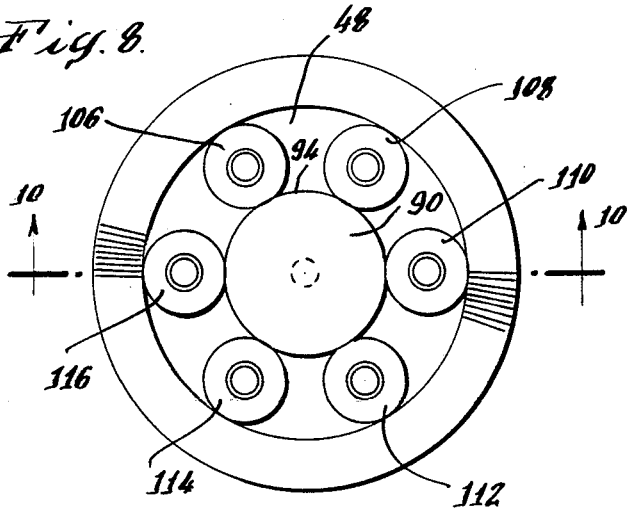
FIG. 8 is a top plan view of a further alternative embodiment of the depilatory device of the invention.
Figure 9:
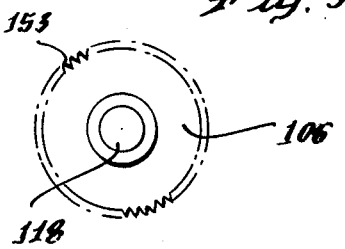
FIG. 9 is an enlarged top plan view of a rotary body used with the device of FIG. 8.
Figure 10:
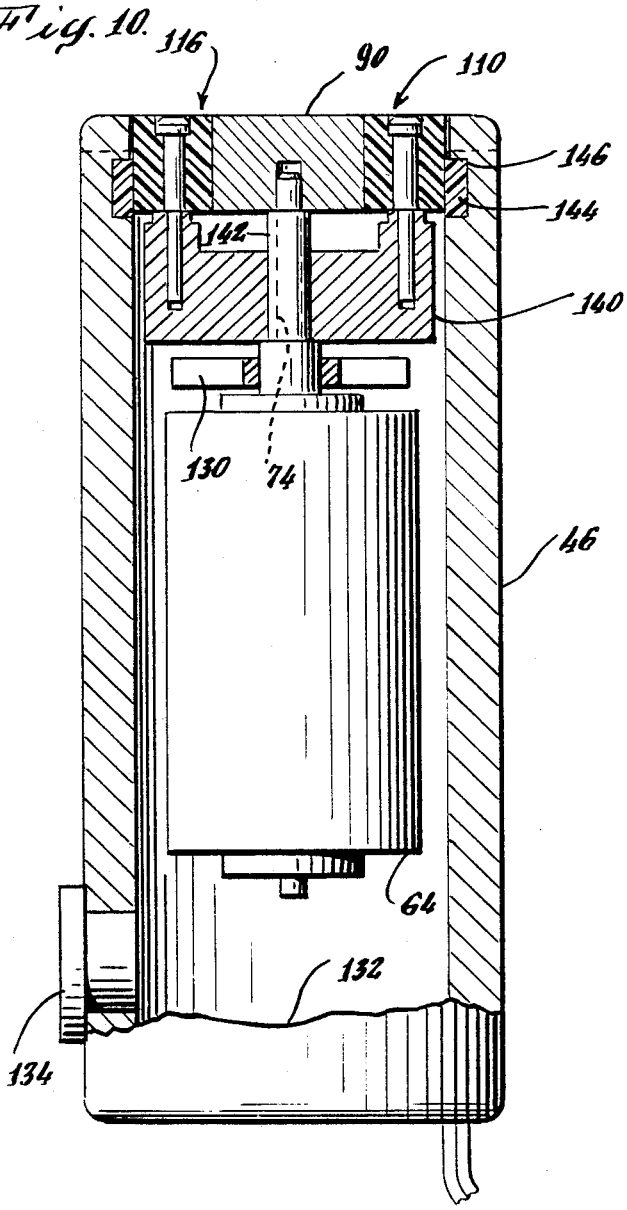
FIG. 10 is a side elevation view, partly broken away and partly in section of the device of FIG. 8.

FIGS. 8–10 illustrate an alternative arrangement of the device of FIGS. 5–7. In the arrangement of FIGS. 8–10, the array of relatively smaller diameter hair removal members 106–116 is mounted on a circular shaped carousel body 140. The carousel body 140 is rotatably supported about the motor drive shaft 74 by a bearing 142 which permits the carousel 140 to rotate freely about the drive shaft 74. A friction pad 144 formed of rubber for example is fitted in a circular groove 146 which is formed in the inner wall 100 of housing body 46 and engages the peripheral surfaces of the members 106–116. Upon energization of the electrical motor 64, rotary motion will be imparted to the driven centrally located hair removal member 90 which in turn, by virtue of the engagement between the peripheral surfaces of the member 90 and the array of members 106–116, causes rotation of these individual members about their shafts 118. In addition however the array itself will also rotate so that in operation, the circular array of hair removal members will experience rotation about their individual axes as the axes rotate about the relatively larger centrally located hair removal member 90. This overall operation enhances the hair gathering and removal efficiency.

Figure 11:
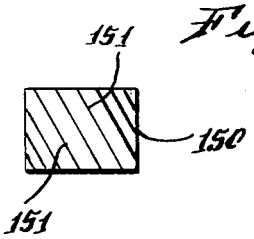
FIG. 11 is a side elevation view of a hair removal member used with the device of FIG. 1 and having a scored peripheral surface.
Figure 12:
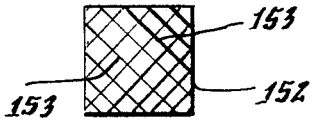
FIG. 12 is a side elevation view of an alternative arrangement of a hair removal member of the invention having a knurled peripheral surface.
Figure 13:
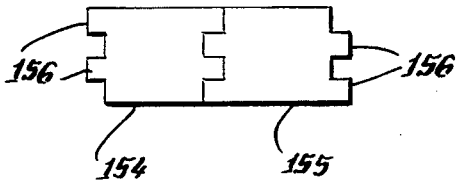
FIG. 13 is a side elevation view of hair removal members used with the invention and illustrating peripheral surfaces having horizontally extending tooth segments formed therein.
Figure 14:
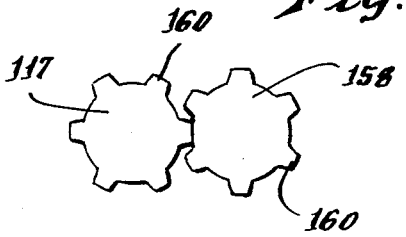
FIG. 14 is a top plan view of hair removal members used with the invention and illustrating vertically extending tooth segments formed in the peripheral surface thereof; and, FIG. 15 is a schematic view illustrating use of the depilatory device of this invention.

Gripping of hairs to be removed as well as engagement between the peripheral surfaces of a driven hair removal member and a driving hair removal member are enhanced by increasing the frictional engagement between the juxtaposed peripheral surfaces. This can be provided by selection of materials and by forming recesses in the same. In a preferred arrangement, the driving hair removal member is preferably formed of rubber or of a relatively soft plastic. The driven member 24 of FIG. 1 and 90 of FIGS. 5 and 8 is preferably formed of a metal such as brass or a relatively hard plastic such as molded DELRIN. In general, it is preferable that the drive wheel exhibit a hardness which is less than the driven wheel. FIGS. 11–14 illustrate alternative embodiments for forming recesses in the peripheral surfaces of the hair removal members. FIG. 11 illustrates a hair removal member 150 having scoring lines 151 formed in the peripheral surface thereof. FIG. 12 illustrates a hair removal member 152 in which the peripheral surface is knurled. As represented by reference numeral 153. FIGS. 13 and 14 illustrate hair removal members with toothed segments formed in juxtaposed surfaces of a driven and driving member. In FIG. 13, hair removal members 154 and 155 have toothed segments 156 which extend horizontally and mesh while in FIG. 14, hair removal members 157 and 158 have toothed segments 160 extend in a longitudinal direction and mesh. In practice, the motor drive shaft 74 rotates at a speed in the range of about 2,000 to 10,000 RPM and preferably in the range of 6,000/8,000 RPM.

While there has been a described an improved depilatory device, it will be apparent to those skilled in the art that variations may be made thereto without departing from the spirit of the invention and the scope of the appending claims.

What is claimed is:

1. A depilatory device comprising:

a. a plurality of hair removal member each comprising a generally cylindrically-shaped body having a peripheral surface, a longitudinal axis and an end surface thereof;

b. said axes aligned substantially parallel and spaced apart a distance for establishing juxtaposed engagement between said peripheral surfaces;

c. a housing for said device having an aperture therein for entry of body hairs to be removed;

d. said aperture extending in a direction generally transverse to said longitudinal axes; and, e. an electrically energized motor means for imparting rotary motion to said hair removal members whereby manually orientating said axes substantially perpendicular to the surface of a subject's skin at a body site from which hair is to removed and positioning said end surfaces is juxtaposed relation with the subject's skin at said site provides an uprooting engagement of the subject's body hair between rotating peripheral surfaces of said hair removal members.

2. The depilatory device of claim 1 wherein a peripheral surface of at least one of said members includes recesses formed therein.

3. The depilatory device of claim 2 wherein said recesses comprise a scoring of said peripheral surface.

4. The depilatory device of claim 3, wherein said recesses comprise a knurling of said peripheral surface.

5. The depilatory device of claim 2 wherein said recesses comprise tooth shaped segments formed in said peripheral surface.

6. The depilatory device of claim 4 wherein said recesses are formed in said peripheral surface of said second member.

7. The depilatory device of claim 2 wherein said recesses are formed in said peripheral surfaces of said first and second members.

8. The depilatory device of claim 2 wherein at least one of said members is formed of rubber.

9. The depilatory device of claim 2 wherein at least one of said members is formed of a rigid polymer plastic.

10. The depilatory device of claim 2 wherein said peripheral surfaces have tooth shaped segments formed therein which intermesh.

11. The depilatory device of claim 2 wherein said peripheral surfaces are formed of materials which establish frictional engagement therebetween.

12. A depilatory device comprising:

a. a hand-held housing;

b. said housing having an end segment thereof and an aperture formed in said end segment for entry of body hairs to be removed;

c. a plurality of hair removal members each comprising a generally cylindrically-shaped body having a peripheral surface, a longitudinal axis and an end surface thereof;

d. means for mounting said members for providing that said axes are aligned substantially transverse to said aperture and parallel with each other and are spaced apart a distance for establishing juxtaposed engagement between said peripheral surfaces, said end surfaces positioned adjacent said housing aperture and extending substantially in a same plane; and, e. an electrically energized motor means positioned in said housing for imparting rotary motion to said hair removal members whereby manually orientating said housing for alignment of said member axes substantially perpendicular to a subject's skin at a body site from which hair is to removed and positioning said aperture in juxtaposed relation with the subject's skin at said site provides an uprooting engagement of the subject's body hair between rotating peripheral surfaces of said hair removal members.

13. The depilatory device of claim 12 wherein said plurality of hair removal members comprises first and second members.

14. The depilatory device of claim 13 wherein said first member is coupled to said electrically energized motor means for imparting rotary motion to said first member, said second member is rotatably mounted and said first member imparts rotary motion to said second member by engagement between said peripheral surfaces.

15. The depilatory device of claim 12 wherein said end surfaces are positioned substantially flush with a housing surface defining said aperture.

16. The depilatory device of claim 15, wherein said bodies extend beyond a surface defining said aperture.

17. A depilatory device comprising:

a. a hand-held housing;

b. said housing having an end segment and an aperture formed therein for juxtapositioning with a subject's skin at a body site for removal of body hair therefrom;

c. a first hair removal member comprising a cylindrically shaped idler body having a peripheral surface, a longitudinal axis and an end surface thereof;

d. means for rotably mounting said member for providing that said end surface is positioned adjacent said housing aperture;

e. A second hair removal member comprising a cylindrically shaped driver body having a peripheral surface, a longitudinal axis and an end surface thereof;

f. said second member end surface positioned adjacent said housing aperture;

g. Said member axes extending transverse to said aperture and aligned substantially parallel and spaced apart a distance for providing that said peripheral surfaces are positioned in juxtaposed engagement whereby rotation of said second member imparts rotary motion to said first member; and h. An electrically energized means positioned in said housing and coupled to said first member for imparting rotary motion thereto whereby manually positioning said housing for alignment of said axes substantially perpendicular to the subject's skin at the site where body hair is to be removed and said aperture in juxtaposed relation with the subject's skin enables uprooting engagement of the subject's body hair between rotating peripheral surfaces of said hair removal members.

18. A depilatory device comprising:

a. A hand-held housing;

b. said housing having an aperture formed therein;

c. first, second and third hair removal members each comprising a generally cylindrically-shaped body having a peripheral surface, a longitudinal axis and an end surface thereof;

d. means for mounting said members for providing that said axes are aligned substantially parallel and spaced apart a distance for establishing juxtaposed engagement between said peripheral surfaces and that said end surfaces are positioned adjacent said housing aperture and extend substantially in a same plane;

e. an electrically energized motor means positioned in said housing for imparting rotary motion to said first hair removal member;

f. means for rotatably moving said second and third hair removal members;

g. said peripheral surface of said first hair removal members positioned in juxtaposed engagement with said peripheral surface of said second and third members whereby said first member imparts rotary motion to said second and third members by engagement between peripheral surfaces; and, h. whereby manually orientating said housing for alignment of said member axes substantially perpendicular to a subject's skin at a body site from which hair is to removed and positioning said aperture in juxtaposed relation with the subject's skin at said site provides an uprooting engagement of the subject's body hair between rotating peripheral surfaces of said hair removal members.

19. The depilatory device of claim 18 wherein said axes of said hair removal member are aligned along a transverse, rectilinear plane.

20. A depilatory device comprising:

a. a plurality of hair removal members each comprising a generally cylindrically-shaped body having a peripheral surface, a longitudinal axis and an end surface thereof;

b. said axes aligned substantially parallel and spaced apart a distance for establishing juxtaposed engagement between said peripheral surfaces; and, c. an electrically energized motor means for imparting rotary motion to said hair removal members;

d. said plurality of members comprise a first hair removing member of diameter D and a plurality of members arrayed about said first member, each of said members in said array having a diameter relatively smaller than D; and, e. whereby manually orientating said axes substantially perpendicular to the surface of a subject's skin at a body site from which hair is to removed and positioning said end surfaces in juxtaposed relation with the subject's skin at said site provides an uprooting engagement of the subject's body hair between rotating peripheral surfaces of said hair removal members.

21. The depilatory device of claim 20 wherein said first member is coupled to said electric motor means for imparting rotary motion thereto, said members of said array are rotably mounted in peripheral surface engagement with said first member and said first member imparts rotary motion to said members of said array.

22. The depilatory device of claim 20 wherein said members of said array are positioned in a circular array about said first member.

23. The depilatory device of claim 22 wherein said circular array of members is supported for rotation in a direction counter to the direction of rotation of said first member.

24. The depilatory device of claim 23 wherein said circular array is supported by a ring shaped member and said ring shaped member is rotatably mounted.

25. A depilatory device comprising:

a. a hand-held housing;

b. said housing having an aperture formed therein;

c. a plurality of hair removal members each comprising a generally cylindrically-shaped body having a peripheral surface, a longitudinal axis and an end surface thereof;

d. means for mounting said members for providing that said axes are aligned substantially parallel and spaced apart a distance for establishing juxtaposed engagement between said peripheral surfaces and that said end surfaces are positioned adjacent said housing aperture and extend substantially in a same plane; and e. an electrically energized motor means positioned in said housing for imparting rotary motion to said hair removal members whereby manually orientating said housing for alignment of said member axes substantially perpendicular to a subject's skin at a body site from which hair is to removed and positioning said aperture in juxtaposed relation with the subject's skin at said site provides an uprooting engagement of the subject's body hair between rotating peripheral surfaces of said hair removal members; and, f. said aperture is formed by a housing wall having a distal edge segment thereof and hair comb tooth segments are integrally formed in said distal edge segment of said aperture for combing hair at said body site.

* * * * *